US009366117B2

(12) United States Patent
Van Riet et al.

(10) Patent No.: US 9,366,117 B2
(45) Date of Patent: Jun. 14, 2016

(54) METHOD AND SYSTEM FOR LINING A SECTION OF A WELLBORE WITH AN EXPANDABLE TUBULAR ELEMENT

(75) Inventors: Egbert Jan Van Riet, Rijswijk (NL); Feitze Veenstra, Joure (NL); Jan Harm Van Der Wal, Joure (NL); Antonius Leonardus Maria Wubben, Rijswijk (NL); Djurre Hans Zijsling, Rijswijk (NL)

(73) Assignee: Enventure Global Technology, LLC, Houston, TX (US)

( * ) Notice: Subject to any disclaimer, the term of this patent is extended or adjusted under 35 U.S.C. 154(b) by 867 days.

(21) Appl. No.: 13/509,679

(22) PCT Filed: Nov. 16, 2010

(86) PCT No.: PCT/EP2010/067537

§ 371 (c)(1),
(2), (4) Date: May 14, 2012

(87) PCT Pub. No.: WO2011/058187

PCT Pub. Date: May 19, 2011

(65) Prior Publication Data

US 2012/0298379 A1 Nov. 29, 2012

(30) Foreign Application Priority Data

Nov. 16, 2009 (EP) ..... 09176047

(51) Int. Cl.
*E21B 23/00* (2006.01)
*E21B 43/10* (2006.01)

(52) U.S. Cl.
CPC ..... *E21B 43/103* (2013.01); *E21B 43/105* (2013.01)

(58) Field of Classification Search
CPC ..... E21B 23/01; E21B 43/103; E21B 43/105; E21B 43/106; E21B 43/108
USPC ..... 166/382, 206, 207, 208, 212
See application file for complete search history.

(56) References Cited

U.S. PATENT DOCUMENTS 6,568,471 B1 5/2003 Cook et al. ..... 166/177.4
7,117,941 B1 * 10/2006 Gano et al. ..... 166/207

(Continued)

FOREIGN PATENT DOCUMENTS

CN 1575372 2/2005
CN 1965147 7/2010

(Continued)

OTHER PUBLICATIONS

GCC Examination Report dated Dec. 4, 2013 for corresponding GCC Application No. GC 2010-17124 (6 pgs.).

(Continued)

*Primary Examiner* — Kenneth L Thompson
*Assistant Examiner* — Michael Wills, III
(74) *Attorney, Agent, or Firm* — Derek V. Forinash; Porter Hedges LLP

(57) ABSTRACT

A system and method for lining a section of a wellbore with an expandable tubular element. The system comprises an elongate drill string having a force multiplier near a lower end thereof, which is housed within the expandable tubular element. An expander for expanding the tubular element is arranged at a lower end of the force multiplier. Anchoring means are provided at the exterior of the tubular element for anchoring the tubular element in the wellbore. Pulling the expander through the expandable tubular using the force multiplier may be combined with pulling the drill string upwards. A sudden drop of the hydraulic pressure in the force multiplier drops will confirm fixation of the anchoring means in the wellbore wall.

13 Claims, 14 Drawing Sheets

(56) References Cited

U.S. PATENT DOCUMENTS

| | | | | |
|---|---|---|---|---|
| 7,255,177 | B2 * | 8/2007 | Duggan et al. | 166/380 |
| 7,367,391 | B1 * | 5/2008 | Stuart et al. | 166/208 |
| 2004/0159446 | A1 | 8/2004 | Haugen et al. | |
| 2004/0216925 | A1 | 11/2004 | Metcalfe et al. | |
| 2005/0056433 | A1 * | 3/2005 | Ring et al. | 166/384 |
| 2005/0161213 | A1 * | 7/2005 | Sonnier et al. | 166/207 |
| 2005/0194152 | A1 | 9/2005 | Campo | 166/384 |
| 2005/0217866 | A1 * | 10/2005 | Watson et al. | 166/384 |
| 2006/0243444 | A1 * | 11/2006 | Brisco et al. | 166/298 |
| 2006/0244352 | A1 | 11/2006 | Tatsumi et al. | |
| 2007/0187113 | A1 | 8/2007 | Hester et al. | |
| 2008/0156499 | A1 * | 7/2008 | Giroux et al. | 166/380 |
| 2008/0223568 | A1 * | 9/2008 | Roggeband et al. | 166/55 |
| 2008/0277111 | A1 * | 11/2008 | Braddick | 166/206 |
| 2009/0065196 | A1 * | 3/2009 | Holland et al. | 166/207 |
| 2009/0242213 | A1 * | 10/2009 | Braddick | 166/384 |
| 2009/0266560 | A1 * | 10/2009 | Ring et al. | 166/384 |

FOREIGN PATENT DOCUMENTS

| | | | |
|---|---|---|---|
| WO | 02081863 | 10/2002 | |
| WO | WO02081863 | 10/2002 | E21B 43/10 |
| WO | 03024708 | 3/2003 | |
| WO | WO03024708 | 3/2003 | B32B 15/00 |
| WO | 03036025 | 5/2003 | |
| WO | WO03036025 | 5/2003 | E21B 43/10 |
| WO | 03074838 | 9/2003 | |
| WO | WO03074838 | 9/2003 | E21B 43/10 |
| WO | 03004278 | 11/2003 | |
| WO | WO03094278 | 11/2003 | H01M 8/04 |
| WO | 2009074573 | 6/2009 | |

OTHER PUBLICATIONS

Chinese Office Action dated Feb. 24, 2014 for corresponding Chinese Application No. 201080051730.4 (39 pgs.).

Search Report and Written Opinion dated Apr. 8, 2011 for corresponding International Application No. PCT/EP2010/067537 (10 pgs.).

* cited by examiner

METHOD AND SYSTEM FOR LINING A SECTION OF A WELLBORE WITH AN EXPANDABLE TUBULAR ELEMENT

PRIORITY CLAIM

The present application claims priority from PCT/US2010/067537, filed 16 Nov. 2010, which claims priority from European Application EP 09176047.0, filed 16 Nov. 2009, which are incorporated herein by reference.

TECHNICAL FIELD OF THE INVENTION

The present invention relates to a system for lining a section of a wellbore with an expandable tubular element.

BACKGROUND OF THE INVENTION

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing, which is to be installed in a lower borehole interval, is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli may be provided between the outer surfaces of the casings and the borehole wall to seal the casings from the borehole wall.

As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

At the surface end of the wellbore, a wellhead is formed that typically includes a surface casing, a number of production and/or drilling spools, valving, and a Christmas tree. Typically the wellhead further includes a concentric arrangement of casings including a production casing and one or more intermediate casings. The casings are typically supported using load-bearing slips positioned above the ground.

Conventionally, a wellbore casing cannot be formed during the drilling of the wellbore. Typically, the wellbore is drilled and then the wellbore casing is introduced in the newly drilled section of the wellbore. This delays the completion of a well. Moreover, the time it takes to retrieve the drill string and to subsequently introduce the casing may be longer than the time it takes for a part of the wellbore wall to collapse. Collapse of the walls of the wellbore is relatively expensive. As the time to retrieve the drill string increases with increasing depth of the wellbore, the risk of a collapsing wellbore wall also increases with increasing depth.

This risk is also significant during the creation of a sidetrack of an existing wellbore. Sidetracks may extend the life of a wellbore, by extending into the oil-bearing formation at an angle with respect to the original wellbore. In addition, when creating a sidetrack of an existing wellbore, the curvature of the sidetrack may prevent the introduction of a liner, thus limiting the depth and/or configuration of the sidetrack.

It has been proposed to overcome the problem of stepwise smaller inner diameters of wellbore casing by installing a tubular element in a wellbore and thereafter radially expanding the tubular element to a larger diameter. The tubular element may be expanded by means of an expander, which is for instance pulled, pushed or pumped through the tubular element.

WO-03/036025 provides a system for lining a section of a wellbore with an expandable tubular element. The system comprises an elongate drill string extending into the wellbore. The tubular element in unexpanded form encloses a lower portion of the string. The string is provided with an expander at the lower end of the tubular element. After drilling a new section of the wellbore, the expander is pulled upwards through the tubular element, thereby expanding the tubular element. An upper end of the tubular element extends into a lower end of the wellbore casing. Anchoring means including radial expansion means radially expand the upper end part of the tubular element against the casing.

The drill string passes on the relatively great forces involved in pulling the expander through the expandable tubular element. If the outside of the tubular element is provided with anchors for anchoring the tubular element to for instance the wellbore wall or a previous liner or casing section, the required (tractive) force is even greater at or near the location of the anchors, as the anchors must be introduced in the material surrounding the tubular element.

SUMMARY OF THE INVENTION

The present invention aims to provide an improved system for lining a section of a wellbore.

The invention therefor provides a system for lining a section of a wellbore with an expandable tubular element, the system comprising:

- an elongate drill string extending into the wellbore, the drill string comprising a force multiplier near a lower end thereof;
- an expandable tubular element in an unexpanded form thereof enclosing and acting as the housing of the force multiplier; and
- an expander for expanding the tubular element which is arranged at a lower end of the force multiplier.

The expandable tubular element is the housing of the force multiplier. The length of a single stroke of pulling the expander through the tubular element can thus be significantly increased.

In an embodiment, the system comprises anchoring means that are provided at the exterior of the tubular element for anchoring the tubular element in the wellbore. The force multiplier, optionally in combination with pulling the drill string, is able to provide a suitable force for expanding the tubular element and fixating the anchors in the wellbore wall. The system of the invention thus obviates the need for fixating the expandable tubular before expanding it.

According to another aspect, the present invention provides a method of lining a section of a wellbore with an expandable tubular element, comprising the steps of:

- drilling a section of the wellbore using a drill string, wherein the drill string comprises:
  - a force multiplier near a lower end of the drill string;
  - an expandable tubular element in an unexpanded form thereof, at least enclosing and acting as the housing of the force multiplier; and
  - an expander for expanding the tubular element which is arranged at a lower end of the force multiplier;
- the method comprising the further step of:

activating the force multiplier to pull the expander through the expandable tubular element for expanding the tubular element to an expanded form thereof.

In an embodiment, the exterior of the tubular element is provided with anchoring means for anchoring the tubular element in the wellbore. In addition to using the force multiplier, the method may include pulling the drill string and the expander into the expandable tubular element during the step of activating the force multiplier. A drop of the hydraulic pressure used to drive the force multiplier below a threshold pressure may confirm the fixation of the anchoring means in the wellbore wall.

BRIEF DESCRIPTION OF THE DRAWINGS

The invention will now be illustrated in more detail and by way of example with reference to embodiments and the drawing, in which.

In the description below, references to "casing" and "liner" are made without an implied difference between such types of tubular elements. References to "lining" can be understood to mean: providing a liner or a casing in the wellbore.

DETAILED DESCRIPTION OF PREFERRED EMBODIMENTS

An Expandable Liner Drilling system according to the invention (FIG. 1) is a drilling system, which enables an expandable tubular element to be (directionally) drilled into a formation. Subsequently, the tubular element is expanded in the same trip.

Figure 1:
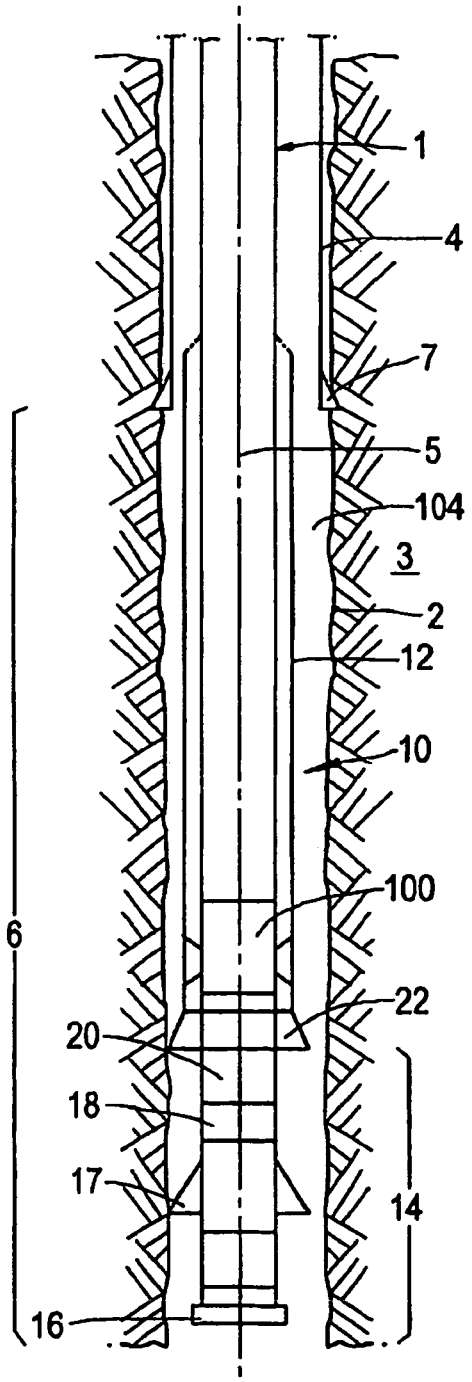
FIG. 1 schematically shows a longitudinal section of an embodiment of a system according to the present invention.

FIG. 1 shows a drill string 1 extending into a wellbore 2, which is formed in an earth formation 3. An upper section of the wellbore 2 is provided with a casing string 4 having longitudinal axis 5. A newly drilled open hole section 6, which has not yet been provided with casing, extends below the casing string 4. The exterior of the casing 4 is, for instance at a lower part thereof, provided with an anchor 7 that is fixated in or against the wall of the wellbore 2. The drill string 1 typically includes a plurality of jointed drill string sections.

An expandable tubular liner 12 is substantially concentrically arranged around a lower portion 10 of the drill string 1. A lower end part of the drill string, i.e. below the liner 12, includes a bottom hole assembly (BHA) 14. The BHA includes for instance a drill bit 16, which may be coupled to an underreamer 17, a drilling motor 18 for driving the drill bit 16, and a measurement while drilling tool (MWD) 20 to aid in the process of directional drilling to a particular location. As an alternative to being coupled to an underreamer 17, the drill bit may be of bi-centred or eccentric type. Other components that are normally used in drilling of wells may be included.

The drill string 1 is further provided with an expansion cone 22. The expander 22 is arranged above the BHA 14, and is suitable for expanding the liner 12 by means of plastic deformation by moving the expansion cone 22 through the liner 12.

The lower part 10 of the drill string includes a force multiplier 100 (FIGS. 1; 3). The force multiplier is arranged to initiate the expansion of the liner 12 after the liner has been drilled to a predetermined depth and position.

Figure 2A:
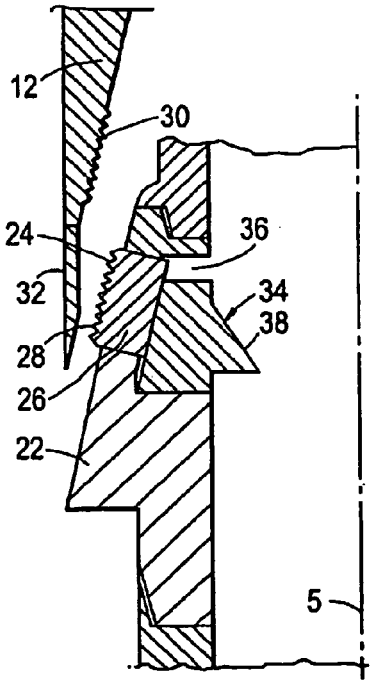
FIG. 2A schematically shows a longitudinal section of an embodiment of an expander suitable for the embodiment of FIG. 1, when released from a lower end of the expandable tubular element.
Figure 2B:
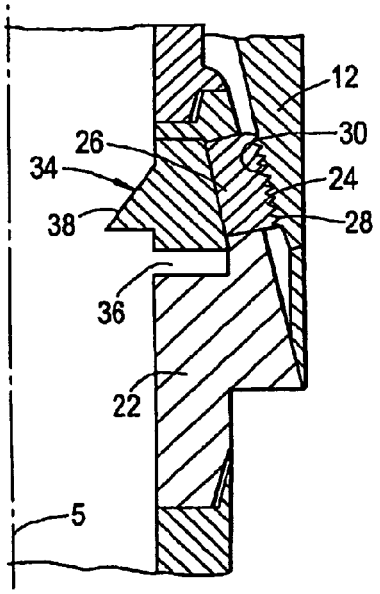
FIG. 2B schematically shows a longitudinal section of the expander of FIG. 2A when secured to the lower end of the expandable tubular element.

Referring to FIGS. 2A and 2B, the expansion cone 22 is for instance provided with releasable support means for supporting the liner 12. The support means includes a plurality of retractable holding blocks 24 circumferentially spaced along the outer surface of the cone 22 and positioned in respective openings 26 arranged in the conical outer surface of the expansion cone 22. The combined outer surfaces of the respective holding blocks 24 form a thread pattern 28, which engages with a complementary thread pattern 30 on the interior of the bottom end of the liner 12. Engagement of the thread pattern 28 with the thread pattern 30 is accomplished by sliding the lower end of the liner 12 with the thread pattern 30 over the thread pattern 28 of the retractable holding blocks 24. A preferred threading direction is counter clockwise. A protection-sleeve 32 is attached to the lower end of the liner 12 to prevent damage to the outer surface of the expansion cone 22.

The expansion cone 22 is at its inner surface provided with a ring 34 arranged in an annular recess 36 of the cone 22. The ring 34 can slide axially within the annular recess 36. In a point of departure, the ring 34 is pushed upwards, for instance by spring force (FIG. 2B). The openings 26 are in fluid communication with the annular recess 36, and the ring 34 and the holding blocks co-operate in a manner that downward sliding of the ring causes radial retraction of the holding blocks 24.

The ring 34 has a landing profile 38 which matches a closing plug or ball (not shown) which can be pumped through the drill string 1. When the closing plug engages the landing profile 38, the fluid circulating passage through the drill string 1 is blocked. Continued pumping of fluid through the string 1 causes the fluid pressure above the closing plug to rise and thereby to slide the ring 34 downwards (FIG. 2A). As a result the holding blocks 24 are allowed to retract radially inward so that the thread 28 at the exterior of the blocks 24 of the expansion cone 22 is released from the thread 30 at the interior of the liner 12.

As described above, the drill string comprises a force multiplier 100. The force multiplier is adapted to pull the expansion cone 22 through the liner 12.

Figure 3:
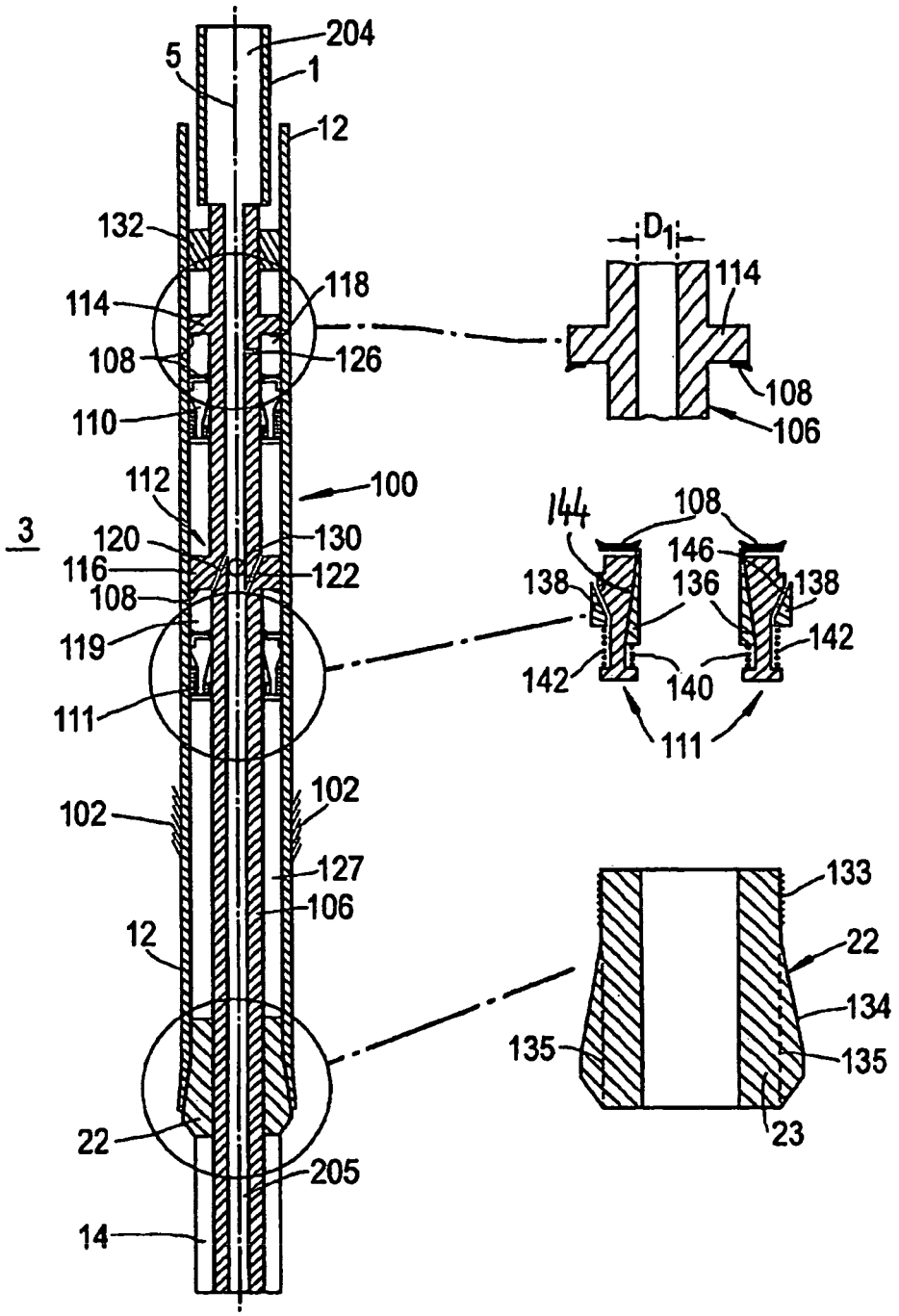
FIG. 3 schematically shows another embodiment of a system according to the present invention.

The exterior of the expandable liner 12 is optionally provided with one or more anchors 102 for anchoring the liner in the formation 3 (FIG. 3). One anchor 102 includes for instance one or more reinforced and/or barbed metal features that can be pushed into the formation when the liner is expanded.

In an embodiment (not shown), the anchor 102 comprises for instance a plurality of metal strips and corresponding wedge parts that are arranged around the circumference of the liner 12. Each strip has one end that is attached to the liner 12 and an opposite free end that is not. The free end is directed towards one of the wedge parts. During expansion the liner will shorten, causing the free end of the metal strips to move along the length of the liner and onto the wedge part. The wedge part will force the free end to move towards and at least partly into the formation, thus setting the anchor.

The force that is required to introduce the anchor 102 at least partially into the formation adds up to the force that is required to expand the liner itself. The required expansion force is thus greatest when the expander 22 passes the position of the anchor 102. The force multiplier can provide the force to pull the expander cone 22 through the liner 12 and past the anchor 102.

Once the anchor 102 has engaged the wellbore wall, the anchor fixates the liner to the wellbore wall. The remainder of the liner can subsequently be expanded by pulling the drill string towards the surface. The force multiplier 100 can assist in pulling the expander 22 through the liner, for instance when the available force to pull the drill string and the expander cone through the liner is insufficient, such as at tight locations of the wellbore or at the position whereat the previous casing 4 overlaps the expandable liner 12 (FIG. 1).

The liner 12 can be expanded against the formation 3. This might obviate the need to introduce cement in an annulus 104 between the liner and the wellbore wall for zonal isolation (FIG. 1). Optionally, cement or a special gel may be introduced in the annulus 104 to prevent fluids from moving along the liner through the annulus 104 in case a small gap would remain between the expanded liner and the formation.

In the embodiment shown in FIG. 3, the force multiplier 100 comprises an arrangement of a pulling shaft 106, fluid seals 108, gripper systems 110, 111, and an activating mechanism 112. The shaft 106 forms a single joint of the force multiplier.

The force multiplier comprises one or more, for instance two, hydraulic stages. The shaft 106 is provided with flanges 114, 116 that extend radially outward towards the liner 12. Each hydraulic stage is comprised of a pressure chamber 118, 119 formed between fluid seals 108 on one of flanges 114, 116 and fluid seals 108 on the gripper systems 110, 111. The liner 12 constitutes the outer shell or wall of the pressure chambers, and the pulling shaft 106 the inner wall.

The flange 116 is provided with two fluid passages 120, 122. The fluid passage 120 connects an interior fluid passage 204 of the drill string 1 above the activating mechanism 112 with the pressure chamber 119. The fluid passage 122 connects an interior fluid passage 205 of the drill string and the shaft 106 below the activating mechanism 112 with a fluid chamber 124 above the flange 116. A fluid passage 126, which passes through the shaft 106 and is located between the flange 114 and the gripper system 110, connects the interior fluid passage 204 of the drill string with the pressure chamber 118.

The activating mechanism is for instance a hydraulic activating mechanism comprising a receiving surface, which is internally arranged within the shaft 106 at the position of the flange 116. The receiving surface (not shown) is adapted to receive an activating device 130, such as a ball or similar blocking means for blocking the fluid passage 204. The ball can be pumped through the interior fluid passage 204 of the drill string by pressurized fluid.

Optionally, the top of the shaft 106 is provided with a releasable connecting part or top anchor 132. The connecting part 132 transfers drilling loads and torque, originating from the BHA 14 during drilling of the wellbore, through the liner rather than through the pulling shaft 106. The connecting part 132 is fixed to the shaft 106 and can releasably engage the interior of the liner. The connecting part comprises for instance rubber or a similar material.

The expander 22 is connected to the liner 12, for instance by a threaded connection 133. In an embodiment, the exterior surface of the expander 22 comprises an emergency release sleeve 134. The emergency release sleeve can be released from the inner part 23 of the expander 22 along the cylindrical interface surface 135. When the emergency release sleeve 134 is disconnected, the inner part 23 of the cone 22 can be retrieved through the unexpanded liner, whereas the emergency release sleeve 134 will remain in the wellbore.

Figure 4:
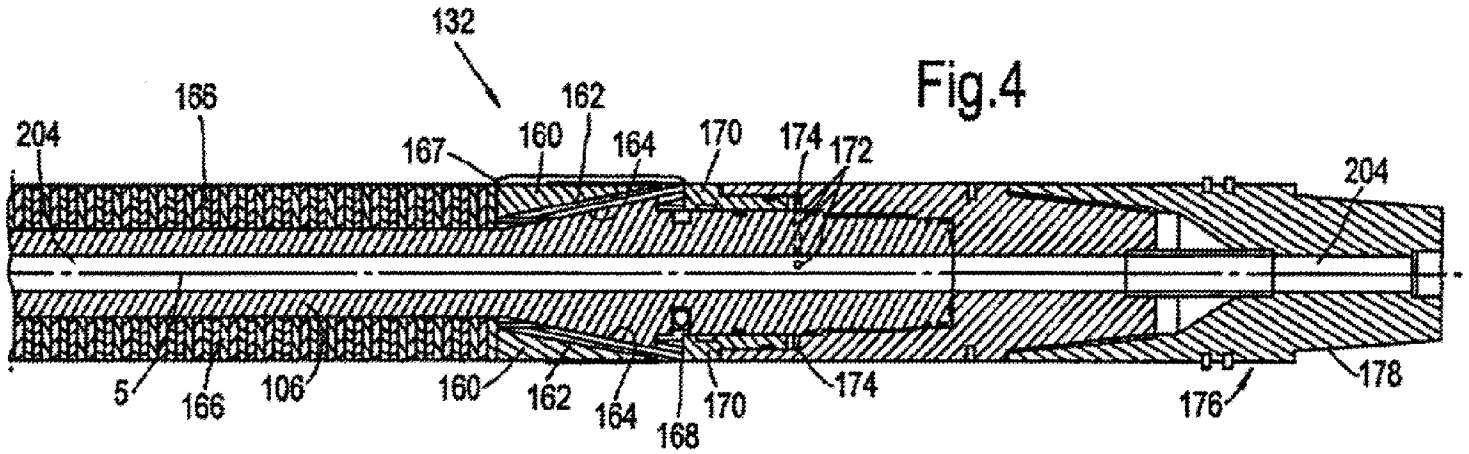
FIG. 4 shows a longitudinal section of an embodiment of a top anchor of the system of the present invention.

In an exemplary embodiment, shown in FIG. 4, the top anchor comprises a wedge part 160 having a wedging surface 162. The shaft 106 is provided with a ramp surface 164 that is a mating surface to the wedging surface 162. Spring part 166, which encloses the shaft 106, engages a first end 167 of the wedge part and forces the wedge part 160 towards the ramp surface. Thereupon, the ramp surface forces the wedge part towards the inner wall of the liner until the wedge part engages the liner wall. A second end 168 of the wedge part, opposite the first end, engages a sleeve 170, which encloses the shaft 106 and is axially moveable along the shaft. A fluid channel 172 through the shaft 106 connects the fluid passage 204 inside the shaft to an annular space 174. The annular space 174 is a cavity within the wall of the shaft 106 which is closed off on one axial end by the sleeve 170. Pressure build up in the space 174 will thus act on a top end of the sleeve 170. FIG. 4 also shows a connection part 176 for connecting the shaft 106 to the drill string 1. The connection part comprises for instance threaded pin member 178.

The gripper systems 110, 111 can releasably engage the interior surface of the expandable liner 12 and the exterior surface of the shaft 106. Each gripper system 110, 111 comprises gripper parts 136, 138 loaded by springs 140, 142. The gripper parts 136, 138 are for instance wedge parts which can slide in axial direction onto corresponding ramp surfaces 144, 146. The first gripper parts 136 face the shaft 106. The second gripper parts 138 face the tubular element 12.

In an initial state, for instance during drilling of the wellbore, the gripper parts 136, 138 may engage both the liner 12 and the shaft 106.

Figure 5:
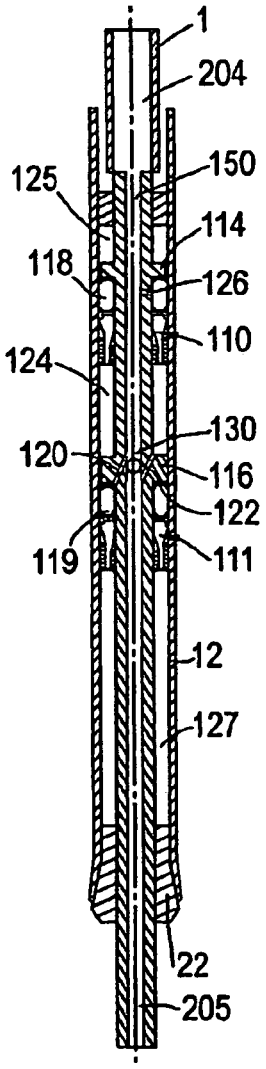
FIGS. 5 to 8 show a schematic representation of consecutive steps of a method according to the present invention.

After drilling a predetermined open hole section of the wellbore, the force multiplier 100 is activated by introducing the activating device 130 in the drill string (FIG. 5). The activating device may include, but is not limited to, a device such as a ball or plug that can be pumped through the drill string. When the activating device 130 engages the receiving surface of the activating mechanism 112, the device 130 blocks the flow of fluid through the passage 204. The fluid pressure of the fluid within the fluid passage 204 is subsequently increased, whereupon the fluid will pass through the fluid passages 172, 120 and 126 due to pressure differences across the respective fluid passages.

Via the fluid channel 172 the pressure in the annular space 174 will increase. When the force, which is exerted on the sleeve 170 by the fluid pressure in the annular space, exceeds the force which is exerted on the sleeve by the spring 166, the fluid pressure will force the sleeve 170 to move towards the spring, thereby forcing the wedge part off the ramp surface 164. When the wedge part moves off the ramp surface, the wedge part 160 of the top anchor 132 is released from the inner liner surface, enabling movement of the liner with respect to the top anchor.

Via fluid passages 120, 126 the pressure chambers 118, 119 are pressurized respectively. The pressure in the pressure chambers 118, 119 acts on the respective fluid seals 108 of the gripper systems 110, 111, causing the gripper parts 136 (FIG. 3) to be released from the shaft 106. At the same time, the gripper parts 138 engage the interior of the liner 12. I.e., the liner and the gripper systems can now move with respect to the shaft 106. Subsequently, the pressure difference between the increasing pressure in the pressure chambers 118, 119 and the (lower) pressure in the fluid chambers 124, 125, 127 forces the flanges 114, 116 and the respective gripper systems 110, 111 to move away from each other (FIG. 5). The shaft 106 moves together with the flanges 114, 116 and pulls the expander 22 through the liner, thereby expanding a lower portion 152 of the liner. The predetermined distance between the gripper system 110 and the flange 116 sets an upper limit to the stroke length of the force multiplier.

When the force multiplier has covered a stroke length (FIG. 6), the fluid pressure of the fluid 150 is reduced. The reduced pressure of the fluid 150 in fluid passage 204 is for instance about equal to or lower than the pressure in the fluid chambers 124, 125 and/or 127.

Figure 7:
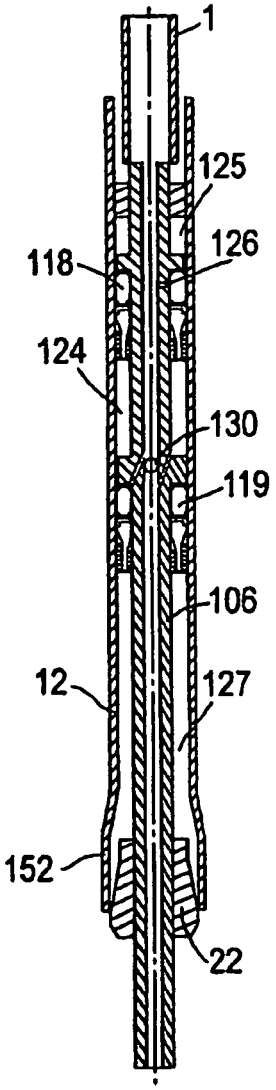

The force multiplier is reset for a next stroke by moving the drill string 1 downwards along a stroke length (FIG. 7). The gripper parts 138 of the gripper systems 110, 111 herein still engage the liner 12, whereas the shaft 106 can slide along the gripper parts 136.

In a subsequent step (FIG. 8), the gripper parts 138 are released, and the gripper parts 136 are activated to engage the shaft 106. The drill string 1 is subsequently pulled upwards. The force multiplier, including the shaft 106 and the gripper systems 110, 111, moves upwards with the drill string until the expander 22 engages an unexpanded portion of the expandable liner 12, i.e. at the top end of expanded portion 152 (FIG. 7).

The expansion sequence using the force multiplier, shown in FIGS. 5 to 8, can be repeated a predetermined number of times. The expansion sequence can for instance be repeated until substantially the entire liner 12 is expanded. Alternatively, the sequence can be repeated until the liner anchor 102 has engaged the wellbore wall, wherein subsequently the remainder of the liner can be expanded by pulling the drill string towards surface.

The force multiplier can also be used in conjunction with mechanical pull of the drill string if required. This can for instance be used to confirm whether the anchor means 102 are fixated in the formation. When fluid pressure is supplied to the force multiplier while at the same time the drill string 1 mechanically pulls the expander 22 into the liner, the fluid pressure in the force multiplier will drop, substantially to zero bar, when the anchor 102 has engaged—and is fixated in—the formation 3.

At the top end part, the liner 12 overlaps a bottom end part of the casing string 4 (FIG. 1). When the expander cone 22 enters the top end part of the liner, the force multiplier will enter in the casing 4. As the internal diameter of the casing 4 is larger the internal diameter of the liner 12, is will be impossible to pressurize the chambers 118 of the force multiplier. The top part of the liner, at least including the part of the liner overlapping the casing 4, may therefore have a reduced wall thickness. The reduced thickness of the liner wall ensures that the force required to pull the expander 22 through the liner and expand the top end part of the liner against the casing 4 can be provided by pulling the drill string to surface.

Figure 9:
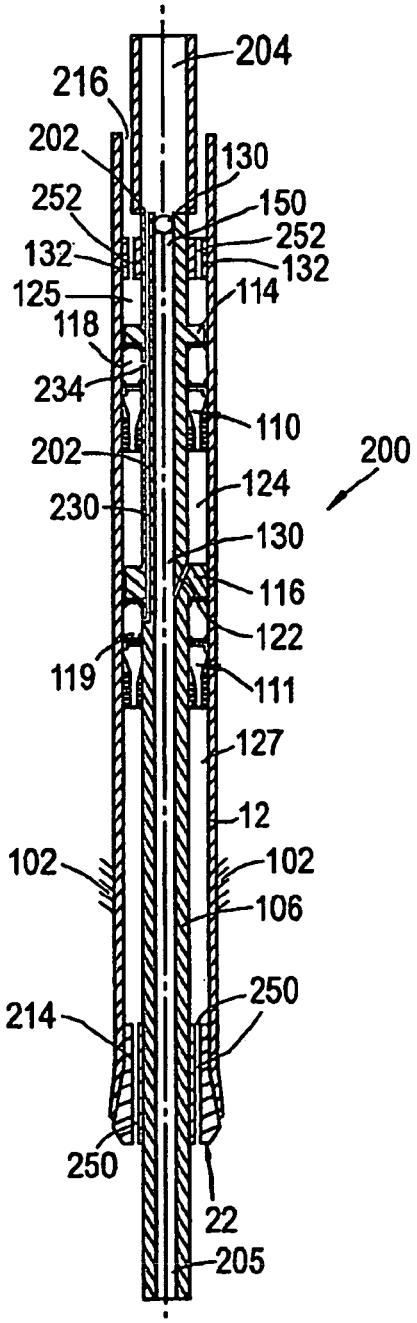
FIG. 9 schematically shows a longitudinal section of yet another embodiment of a system according to the present invention.

FIG. 9 shows another embodiment of the system 200 of the present invention. Parts that are comparable to the parts of system 100 of FIG. 3 are indicated using the same reference numbers.

The system 200 includes a lockable fluid channel 202, having central axis 203, which connects the internal fluid passage 204 of the drill string 1 to the one or more pressure chambers 118, 119.

Figure 11B:
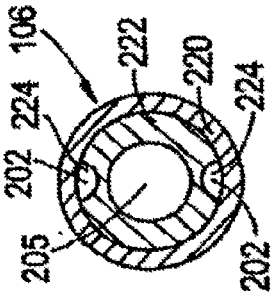
FIG. 11B shows a horizontal section of the mechanism of FIG. 11A along the line XI-XI.
Figure 11A:
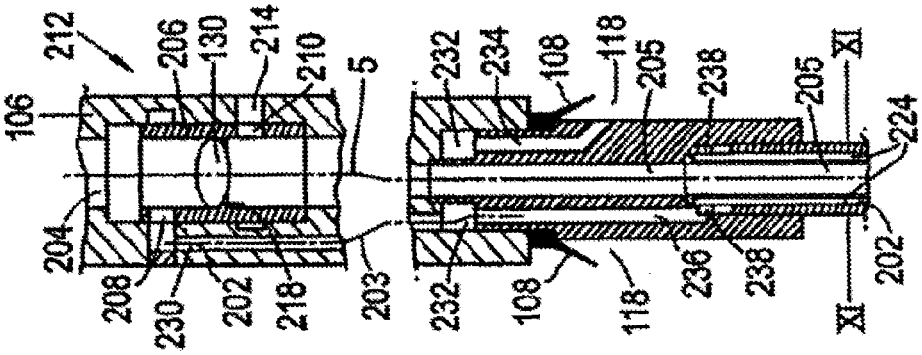
FIG. 11A shows a longitudinal section of an embodiment of the activating mechanism for the system of FIG. 8 in an activated state.
Figure 10A:
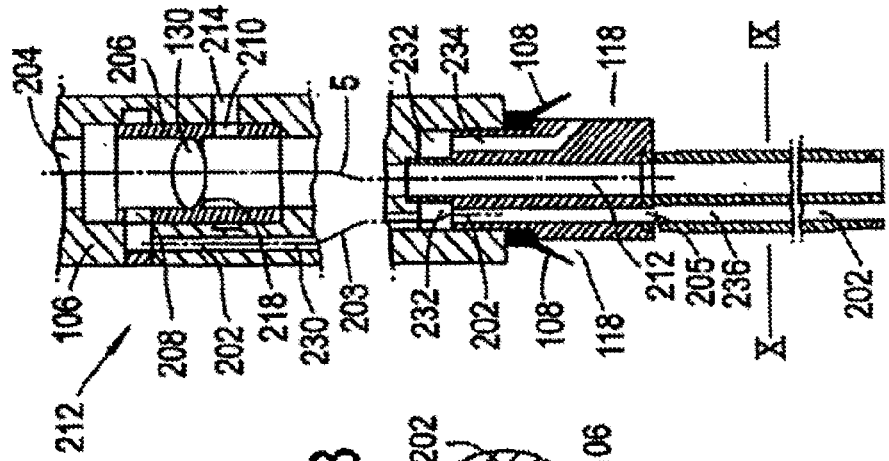
FIG. 10A shows a longitudinal section of an embodiment of an activating mechanism for the system of FIG. 9 in an activated state.

Near a top end, the shaft 106 of the system 200 is provided with activating mechanism 212 (FIGS. 10A, 11A). The activating mechanism 212 comprises a cylindrical sleeve 206 having openings 208, 210. The sleeve 206 is arranged inside the shaft 106 and is moveable along the axis 5 thereof. The shaft 106 is provided with a lockable vent port 214 to connect the internal fluid passage 205 of the pulling shaft 106 below the activating mechanism 212 to an annulus 216 between the drill string 1 and the liner 12. The internal surface of the sleeve 206 is provided with a receiving surface 218 for receiving the activating device 130.

In an inactivated state, for instance during drilling of a section of the wellbore, the sleeve 206 of the activating mechanism 212 closes the fluid channel 202 and the vent port 214.

When the activating mechanism is activated (FIGS. 10A, 11A), the receiving surface 218 has received the activating device 130. Due to fluid pressure above the activating device 130, the sleeve 206 will displace in axial direction, until the openings 208, 210 align with the fluid channel 202 and the vent port 214 respectively, providing a fluid passage.

Figure 12:
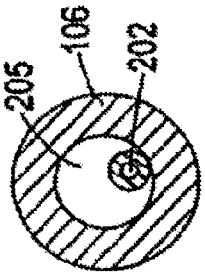
FIG. 12 shows a horizontal section of another embodiment of fluid channels of the activating mechanism.
Figure 10B:
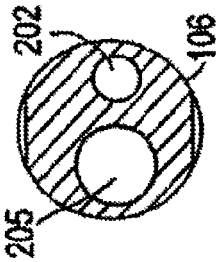
FIG. 10B shows a horizontal section of the mechanism of FIG. 10A along the line X-X.

Exemplary embodiments of the fluid channel 202 are shown in FIGS. 10B, 11B and 12. The shaft 106 can be a rod having two internal longitudinal fluid channels 205, 202 (FIG. 10B). In another embodiment, the shaft 106 comprises and outer tube 220 which tightly encloses an inner tube 222. The hollow inner space within the inner tube 222 constitutes the fluid channel 205. The outer surface of the inner tube 222 is provided with one or more, for instance two longitudinal grooves 224 which together constitute the fluid channel 202 (FIG. 11B). Alternatively, the shaft 106 can be a tube, wherein the fluid channel 202 is a relatively thin tube that is arranged within the hollow inner space of the tube, which constitutes the fluid channel 205 (FIG. 12).

In an embodiment, the fluid channel 202 includes multiple fluid passages, as shown in FIGS. 10A, 11A. A first fluid passage 230 connects the opening 208 to an annular cavity 232. The annular cavity connects to a second fluid channel 234 which connects to the pressure chamber 118. The annular cavity 232 is also connected to a third fluid channel 236 which continues to the second pressure chamber 119 and possible further pressure chambers (not shown).

In the embodiment shown in FIG. 11A, part of the shaft 106 comprises the setup using inner and outer tubes shown in FIG. 11B. The third fluid channel 236 is connected to another annular cavity 238, which connects the third fluid channel to the grooves 224. The grooves 224 provide a fluid channel towards the second pressure chamber 119.

The expander cone 22 is provided with one or more fluid passages 250. The fluid passages connect the fluid chamber 127 to the space below the expander cone 22 to equalize the pressure over the cone.

Similarly, the top anchor 132 may be provided with one or more fluid passages 152 to connect the fluid chamber 125 to the annulus 216 to equalize the pressure over the top anchor.

Figure 13:
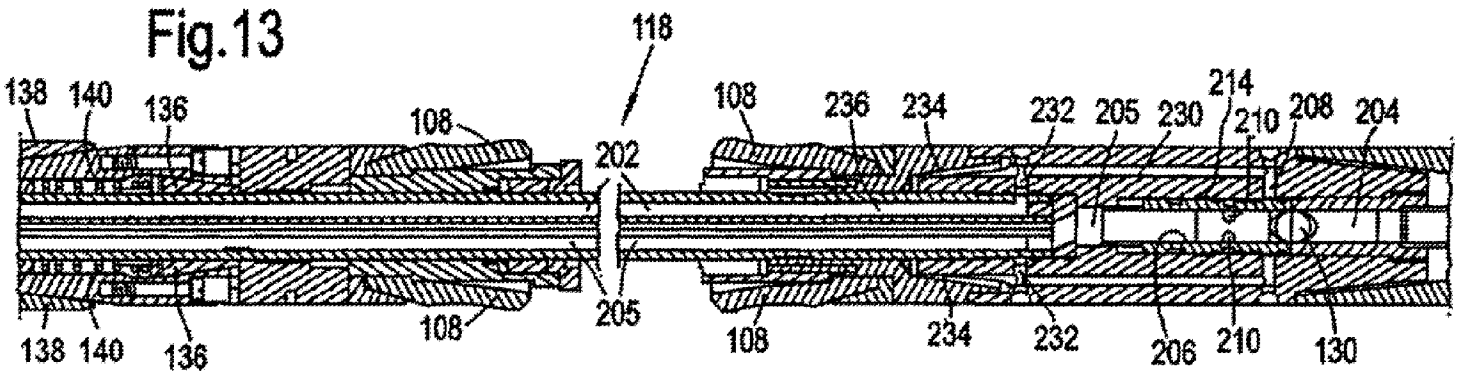
FIG. 13 shows a longitudinal section of an embodiment of a pressure chamber of the system of the present invention.

FIG. 13 shows a more detailed embodiment of the pressure chamber 118, wherein the reference numerals indicate the parts that were described above.

Figure 14:
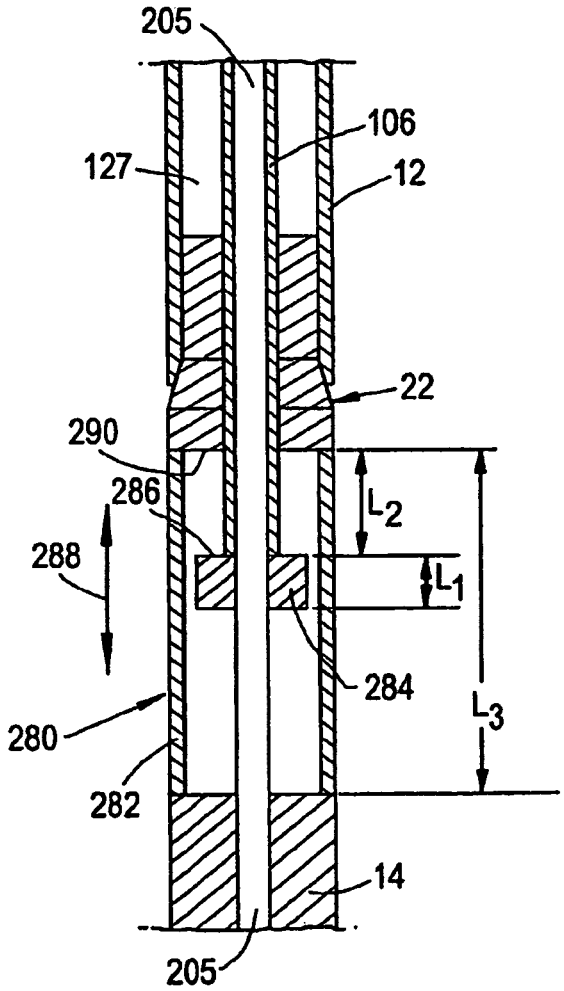
FIG. 14 schematically shows a longitudinal section of an embodiment of a coupling of the system of the present invention to the bottom hole assembly.

In another embodiment, shown in FIG. 14, the system of the invention comprises a coupling member or joint 280 to connect the bottom hole assembly (BHA) 14 to the expander 22. The joint 280 comprises for instance a tube 282 connecting the BHA 14 directly to the expander 22. The outer diameter of the joint is equal to or smaller than the outer diameter of the expander. A lower end of the shaft 106 is provided with a base part 284. The outer diameter of the base part is larger than the outer diameter of the shaft 106, wherein the base part provides a shoulder 286. The shaft can slide within the expander 22, and consequently the base part 284 can move in axial direction within the tube 282 in conjunction with the shaft. This axial movement is indicated by arrow 288. The bottom 290 of the expander 22 constitutes an upper limit for the axial movement of the shoulder 286. L1, L2 and L3 indicate the length or height of the base part 284, the length between the base part and the bottom 290 of the expander, and the length of the tube 282 respectively.

Figure 15:
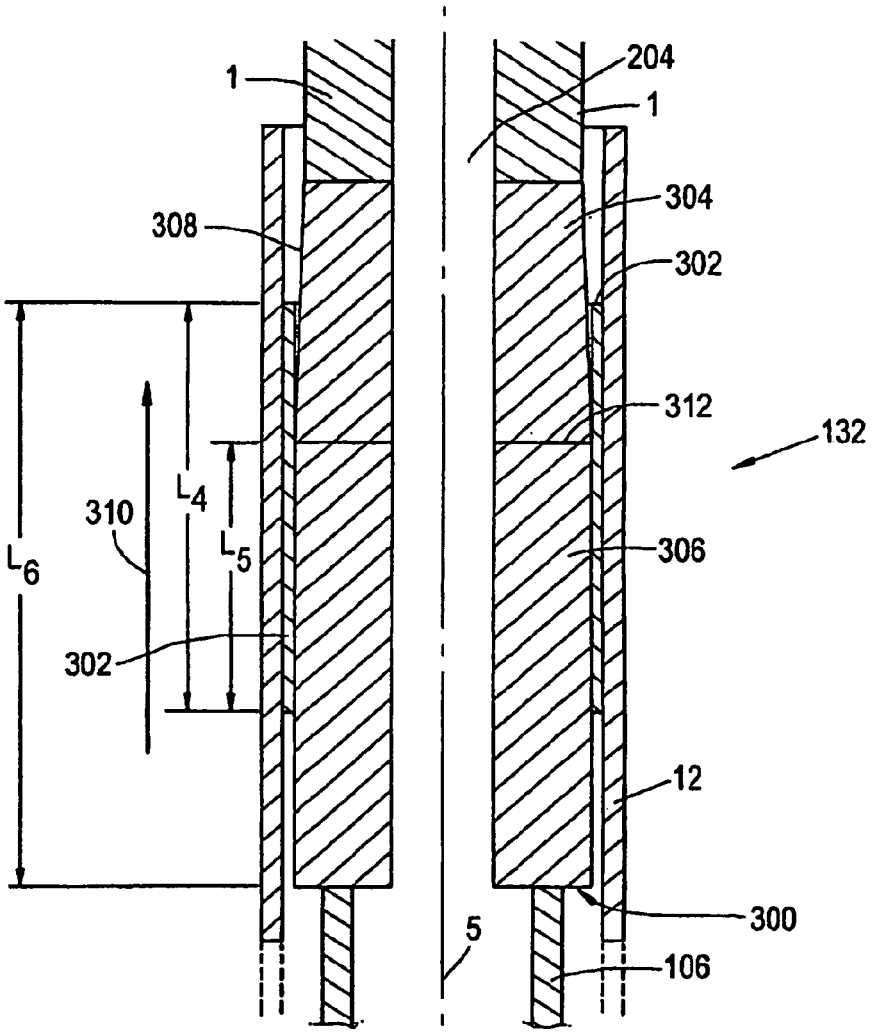
FIG. 15 shows a longitudinal section of another embodiment of a top anchor of the system of the present invention.

In another embodiment, shown in FIG. 15, the top anchor 132 comprises an anchor body 300 and an anchor sleeve 302. The anchor body comprises a top part 304, which is shaped as a truncated cone, and a cylindrical main part 306. The conical top part 304 has tapering outer surface 308. The anchor sleeve is compressed between the anchor body 300 and the tubular 12, by pressing the top anchor into the sleeve in the direction of arrow 310 until the interface 312 between the main part 306 and the top part 304 is approximately in the middle of the sleeve. The top part 304 is connected to the drill string 1, and the main part 306 is connected to the shaft 106. The force multiplier 100 can be used to press the top anchor into the anchor sleeve 302. L4, L5 and L6 indicate the length of the anchor sleeve 203, the length between the bottom of the anchor sleeve and the interface 312, and the length between the bottom of the anchor body 300 and the top of the anchor sleeve 302 respectively.

The frictional forces between the tubular liner 12, the compressed sleeve 302 and the anchor body 300 are predetermined such that these frictional forces exceed the maximum drilling forces. Drilling forces herein indicate the reactive forces, such as torque and forces due to vibration, caused by activation of the bottom hole assembly 14. Thus, the top anchor guides the drilling forces that are transmitted via the tubular liner 12 to the drill string 1. The system of the invention can be guarded from said drilling forces, for instance by using the joint shown in FIG. 14 wherein the shaft 106 can slide unrestricted within the expander cone 22 during drilling so that the joint guides the drilling forces from the BHA 14 to the liner 12.

The top anchor 132 shown in FIG. 15 can be released by activating the force multiplier 100, 200. When the pressure chambers 118, 119 are pressurized, the shaft 106 including the anchor body 300 will be forced upwards, in the direction of the arrow 310. By increasing the fluid pressure in the pressure chambers 118, 119, said upward force increases. When the upward force exceeds the frictional forces that hold the anchor body 300 within the compressed anchor sleeve 302, the anchor body will start to slide through the anchor sleeve 302.

When the system of the invention combines the top anchor 132 shown in FIG. 15 with the joint shown in FIG. 14, the length L2 preferably exceeds the length L6. Then, the shaft 106 can freely slide through the expander 22, so that the entire anchor body 300 can slide through the anchor sleeve 302. As the shaft 106 has a smaller outer diameter than the main body part 306, the top anchor will be released when the entire anchor body 300 has slid through the anchor sleeve 302.

The anchor sleeve 302 can for instance comprise a resilient material, so that the diameter of the anchor sleeve will diminish when the anchor body 300 has been removed. The system of the invention can subsequently start to expand the liner 12 as described above. Suitable resilient materials include some types of steel, such as tool steel and spring steel. Spring steel is a low alloy, medium carbon steel with relatively high yield strength. This allows objects made of spring steel to return to their original shape despite significant bending, twisting, or expansion.

Figure 16:
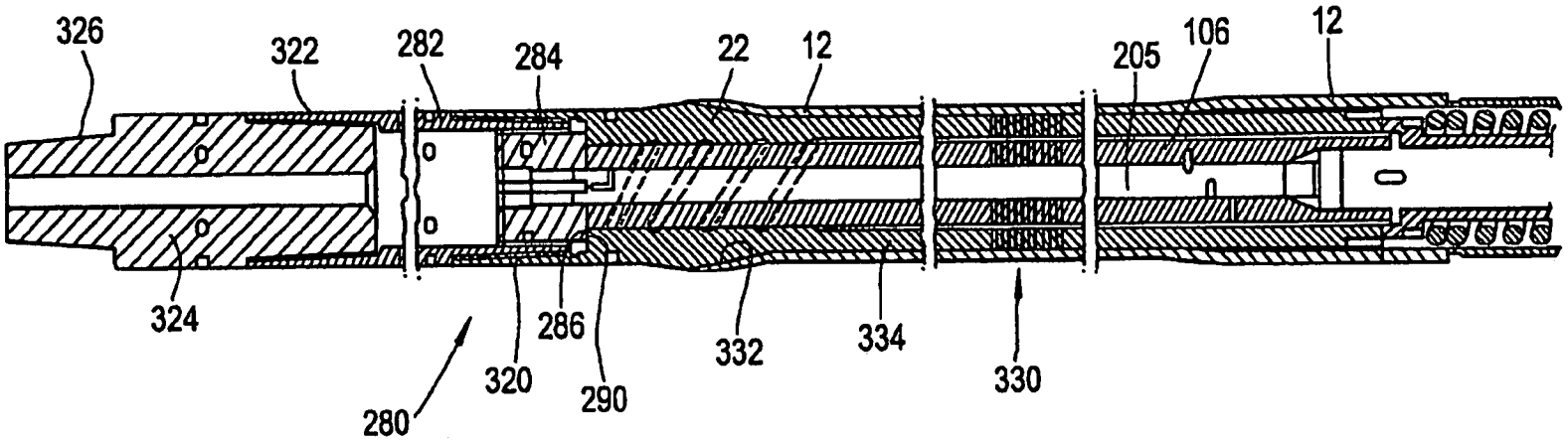
FIG. 16 shows a longitudinal section of an embodiment of the coupling of FIG. 14.

An embodiment of the joint of FIG. 14, shown in FIG. 16, comprises a treaded connection 320 between the expander and the tubular member 282. A second threaded connection 322 connects the tubular member 282 to an additional joint part 324, which is for instance a cylindrical reinforcement part having an increased wall thickness with respect to the tubular member 282. The reinforcement part 324 at its lower end comprises a threaded connection part 326 that can be connected to the BHA 14.

Figure 17:
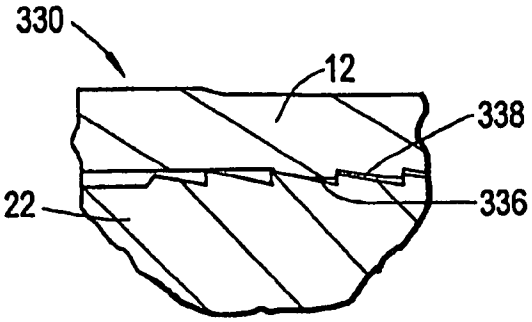
FIG. 17 shows a longitudinal section of an embodiment of a threaded connection of the expander to the tubular element.

The expander may be connected to the liner 12 using threaded connection 330, which is shown in detail in FIG. 17. The expander 22 comprises conical expansion surface 332. An upper part 334 of the expander, which has an outer diameter that fits within the unexpanded liner, is on its outer surface provided with threads 336. The threads 336 connect to mating threads 338 on the inside surface of the liner 12. The threads 336 will engage the threads 338 whenever the expander 22 will move downhole. However, the threads 336 are shaped such that the force enacted by the force multiplier 100, 200 will exceed the force needed to release the threaded connection 330 when the expander will move in the opposite direction.

When the system of the present invention includes the joint shown in FIGS. 14, 17, the operation thereof changes slightly with respect to the operation as described above with reference to FIGS. 5 to 8. The pressure chambers are however pressurized in a similar manner, to force movement of the shaft 106 with respect to the liner 12.

In an initial state, before expansion, the base part may be located near the BHA 14. In a first step, the shaft, including the base part, is forced upward to release the top anchor as described with reference to FIG. 15. Herein, the length L3 exceeds the length L6, so that the entire anchor body can be slid through the anchor sleeve 302 to release the top anchor 132. In a second step, the shaft 106 including the base part continues to move upwards, until the shoulder 286 engages the bottom 290 of the expander. In a third step, the shaft including the base part continues to move upward, wherein the base part 284 forces the expander 22 to move upward through the liner 12. Herein, the threaded connection 330 will be released. The shaft 106 continues to move upward until the pressure chambers 118, 119 meet the limit of one full stroke, comparable to the state depicted in FIG. 6.

When the system is reset for a subsequent stroke, comparable to FIG. 7, the shaft 106 will slide through the expander 22. Herein, the length L3 of the tube 282 is preferable longer than the maximum length of one stroke. Compared to FIGS. 7 and 8, the expander 22 will in this embodiment remain in its position at the interface between the expanded portion 152 and the unexpanded portion of the liner 12, whereas the shaft 106 will slide through the expander. After resetting the system, the base part 284 will engage the bottom 290 of the expander again, and the system may continue with a subsequent expansion stroke.

Figure 18:
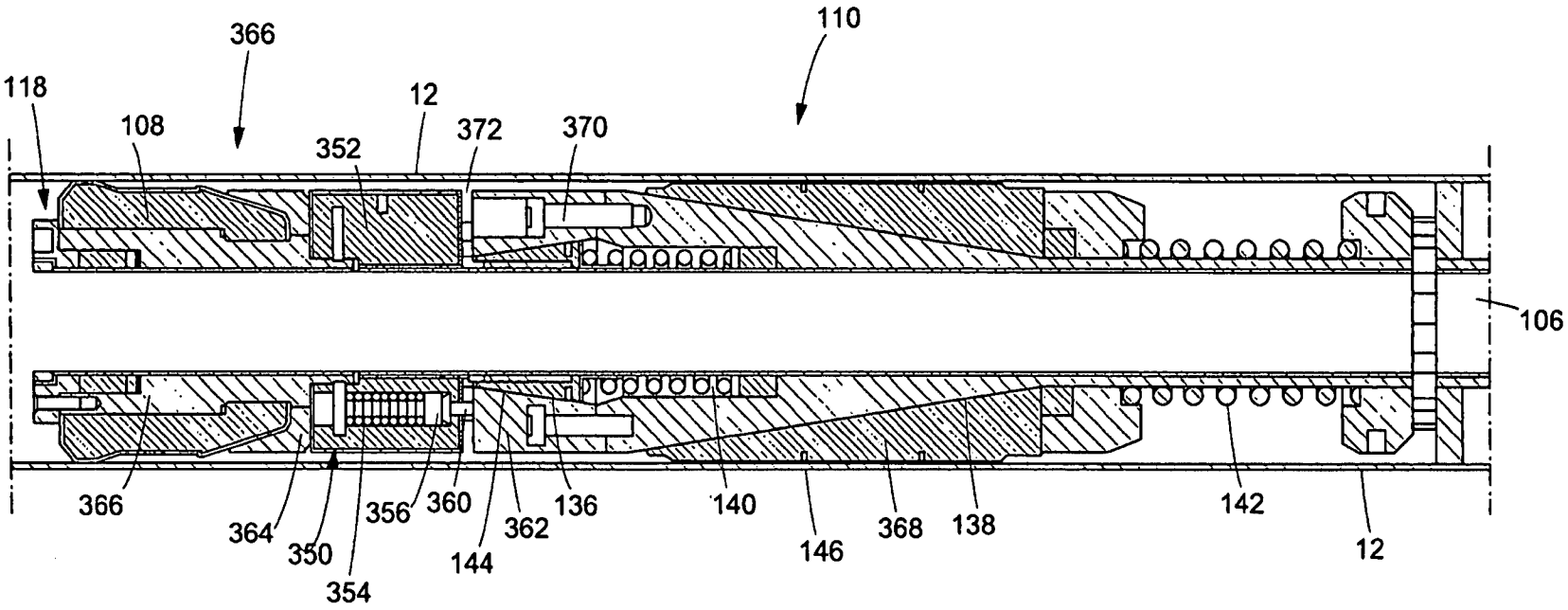
FIG. 18 shows a longitudinal section of an embodiment of a gripper system.

In another embodiment, shown in FIG. 18, the gripper systems 110, 111 may include a pulling shaft gripper synchronizer 350. The synchronizer 350 comprises a cylindrical housing 352 which encloses the pulling shaft 106. Longitudinal cavities 354 are arranged inside the housing 352, which on one end are aligned with openings 356. One or more springs 358 are arranged inside the cavities, which on one end are supported on a wall of the respective cavity and on the other end are connected to a head of a pin 360. The pin itself extends through the corresponding opening 356 and can slide through said opening. The end of the pin 360 opposite to said head is connected to a ramp surface member 362, which comprises the ramp surface 144 facing the shaft 106. An end of the housing 352 opposite to the pin 360 is connected to a support member 364 of a lower fluid seal 366, which is the fluid seal 108 of the pressure chamber 118 on the side of the expander thereof. The seal 108 itself is arranged on and encloses a cylindrical sleeve 366 which is connected to the support member 364.

The gripper system 110 also comprises the inner gripper parts or pulling shaft gripper elements 136 which cooperate with the ramp surfaces 144, and a loading spring 140 for pre-loading the pulling shaft gripper elements 136. Liner gripper wedge 368 comprises ramp surfaces 146, which cooperate with liner gripper segments 138. The liner gripper segments 138 are pre-loaded by liner gripper pre-loading spring 142. The ramp surface member 362 is connected to the liner gripper wedge 368 by connector 370, which may comprise any suitable connector such as a threaded bolt.

The operation of the pulling shaft gripper synchronizer is described herein below. When the pressure chamber 118 is pressurized, the seal 366 pushes the synchronizer 350 towards the ramp surface member 362, wherein the gap 372 between the two components is reduced so that the pulling shaft gripper elements 136 are pushed towards the liner gripper wedge 368. As a result, the pulling shaft gripper elements 136 de-engage the pulling shaft, which allows the pulling shaft 106 to move relative to the pulling shaft gripper elements 136, typically in the locking direction of the segments 136, i.e. towards the left in FIG. 18.

Figure 6:
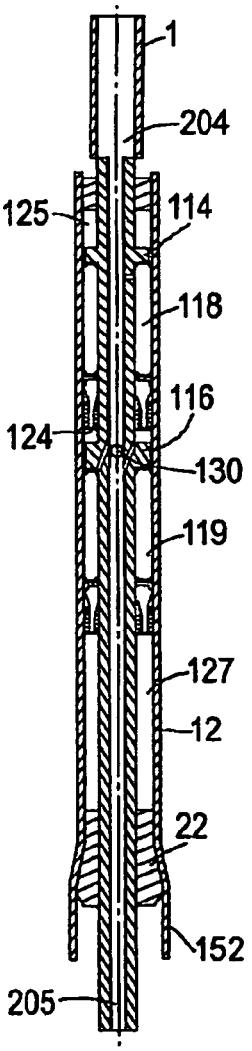
Figure 8:
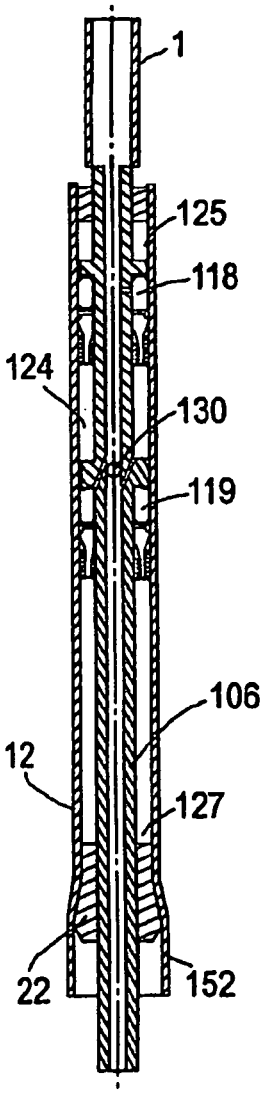

As shown in FIGS. 5 to 8 and the corresponding description above, the expansion system operated using the following sequence of steps:

A) Expansion stroke (FIG. 6);

B) Resetting the gripper systems 110, 111 and closing the high-pressure chambers 118, 119 (FIG. 7); and C) Sliding the expansion tool string through the liner 12 until the cone 22 is pulled against the expanded inner surface of the liner (FIG. 8).

During the sliding action of the pulling shaft 106 during step C (to the left in FIG. 18), the lower seal 366 of the pressure chambers will apply a force on the synchronizer 350 due to friction. During the sliding action the spring 354 of the synchronizer keeps the gap 372 between the synchronizer 350 and the ramp surface member 362 open. The pre-tension in the spring 354 is at least equal to the maximum friction between the lower seal 366 of the respective pressure chamber and the liner 12 during the sliding action of step C.

In addition, the shape of the pulling shaft gripper wedge 362 prevents a self locking condition of the pulling shaft gripper segments 136 when the load is released.

When a pulling load is applied on the pulling shaft 106 during step C, the segments 136 are self-locking. The spring pre-tension of spring 140 pushes the pulling shaft gripper segments 136 towards the lower seal 366, wherein the shape of the wedge 362 pushes the segments 136 towards the pulling shaft resulting in a gripping action. A friction material is preferably applied on the outer surface of the pulling shaft gripper segments that increases friction (for instance, friction coefficient m=0.3-0.5) between the segments 136 and the pulling shaft 106. This friction material does not damage the surface of the pulling rod 106.

The pulling shaft gripper pre-loading spring 140 is set at a specific value that creates sufficient pre-loading on the pulling shaft gripper segments 136. Said loading is such that during resetting of the gripping system in sequence B the friction between the segments 136 and the pulling shaft 106 is minimal.

When wedge component 362 is loaded, de liner gripper wedge 368 is loaded as well. Displacement of the liner gripper wedge 368 towards the liner gripper segments 138 results in a radially outward movement of the liner gripper segments 138, which results in radial loading on the inner surface of the liner 12, anchoring the segments 138 with respect to the liner.

Figure 19:
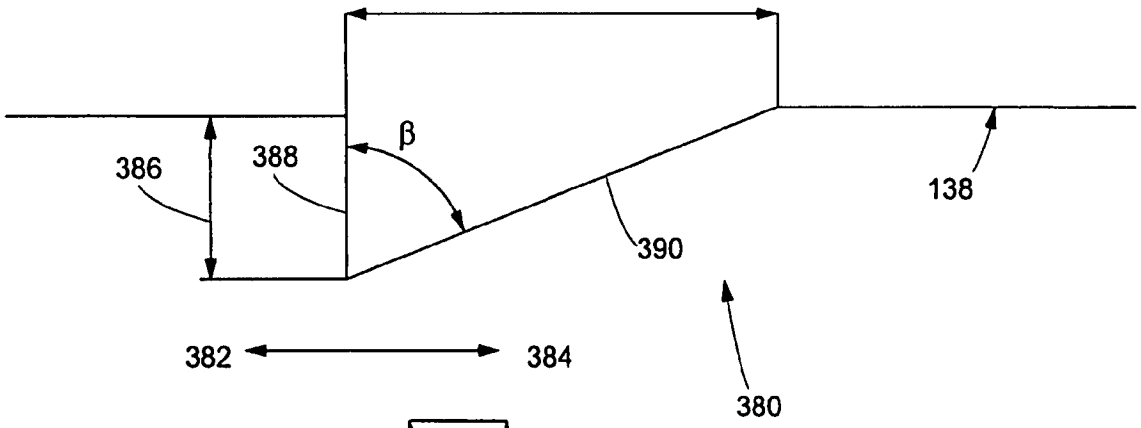
FIG. 19 shows a longitudinal section of an embodiment of a surface of a gripper segment of the gripper system.

The radially outer surface of the liner gripper segments 138, i.e. the surface facing the inner surface of the liner 12, may be provided with one or more teeth 380 (FIG. 19). Said teeth are shaped to engage the liner 12 when the liner gripper segments 138 are pushed towards the expansion cone 22 (to the right in FIG. 18) and to slide at low friction with respect to the liner when the segments 138 slide in the opposite direction. Herein, the teeth are designed to maintain the lubrication of the liner. The length of the liner gripper segments 138 is such that the liner 12 does not expand plastically when the gripper is subjected to the highest, predetermined specified load. The taper of the surface of the liner gripper segment 138 engaging the ramp surface 146 is such that a non-self locking condition is created when the loading on the synchronizer 350 is released.

The teeth 380 have the following functionalities:

1. Anchor the liner gripper 138 to the liner 12 when the tool of the invention is pushed into the locking direction 382; and 2. Slide through the liner 12 at a low friction, in the direction 384, without damaging the lubrication of the liner and hence within impeding the expansion performance.

In an embodiment, the teeth 380 have a height $t_{teeth}$ 386 with respect to the liner gripper 138. A high resistance wall 388 may extend substantially perpendicular with respect to the surface of the liner gripper 138. A sliding wall 390 may extend at an angle with respect to the liner gripper 138. Angle β between the high resistance wall 388 and the sliding wall 390 may be between about 60 to 89 degrees. The height $t_{teeth}$ is slightly greater than 0, for instance in the range of about 0.1 mm to about 3 mm.

The liner gripper pre-loading spring 142 is set at a specific value to ensure sufficient friction between the teeth of the liner gripper segment 138 and the liner 12 to initiate a gripping force when the liner gripper segment is pushed towards the expansion cone.

The gripping system 110 exists of two main components, the liner gripping system and the pulling shaft gripping system.

The objective of the liner gripping system is to create an anchor to the liner in the downward direction (opposite to the expansion direction) during sequence A and B. The liner gripper is able to withstand the maximum required pressure but does not damage the pipe or the lubrication thereof. The liner gripper can be pulled upward (in the direction of the expansion) during sequence C with a minimal pulling force, for instance less than 1% of the load capacity of the expansion tool string. During this sliding action the lubrication on the inner surface of the liner 12 will remain intact, to obviate negative influence on the expansion process.

The objective of the pulling shaft gripping system is to create an anchor to the pulling shaft when no pressure is applied in the high-pressure chamber and the system is pulled upward (in the expansion direction) during sequence C. The required gripping force is equal to the weight and sliding friction of the total gripping system. The gripping action does not damage the surface of the pulling rod.

Both gripping systems are non-self locking, i.e. after releasing the load each gripper segment returns to the pre-tension situation.

The expansion tool can be operated as follows.

1. During sequence A, pressure is applied in the pressure chamber 118. As a result, the lower seal 366 will move downward and load the synchronizer 350;

2. When the load on the synchronizer exceeds the pre-tension of the spring 354 in the synchronizer, the gap 372 will reduce;

3. The minimum required gap distance is equal to the required displacement of the segments 136 to release the pulling shaft gripper;

4. When the load which synchronizer 350 applies on the pulling shaft segment 136 exceeds the pre-tension of the spring 140, the pulling shaft gripper will be released;

5. When the gap 372 between the synchronizer 350 and the ramp surface member 362 is closed, the load of the lower seal 366 will also be applied on the liner gripper wedge 368. This results into a radially outward movement of the liner gripper segments 138, which subsequently anchors the gripper segments 138 to the liner 12;

6. Now the expansion stroke A takes place (see FIG. 6);

7. After the expansion stroke A, the pressure in the pressure chamber 118 is released. The gap 372 between the synchronizer 350 and the wedge member 362 is be restored and the load on the pulling shaft gripper wedge 362 and the liner gripper wedge 368 is removed;

8. During sequence B, the pulling shaft 106 is pushed downward, towards the expansion cone 22. Herein, the friction between the pulling shaft gripper and the pulling shaft will be low due to the liner gripper spring 142 pre-tension. The teeth 380 on the liner gripper segment 138 will be still engage the inner surface of the liner 12.

9. During step C the pulling shaft 106 is pulled in the opposite direction. Herein, the pulling shaft gripper will create an anchor between the pulling shaft gripper segments 136 and the pulling shaft. The liner gripper segments 138 will slide through the liner due to the special shape of the teeth 380. At the end of step C the cone 22 is pulled against the expanded inner surface of the liner and the sequence is repeated, starting at step 1.

In a practical embodiment, design criteria may be derived as substantiated below.

Figure 20:
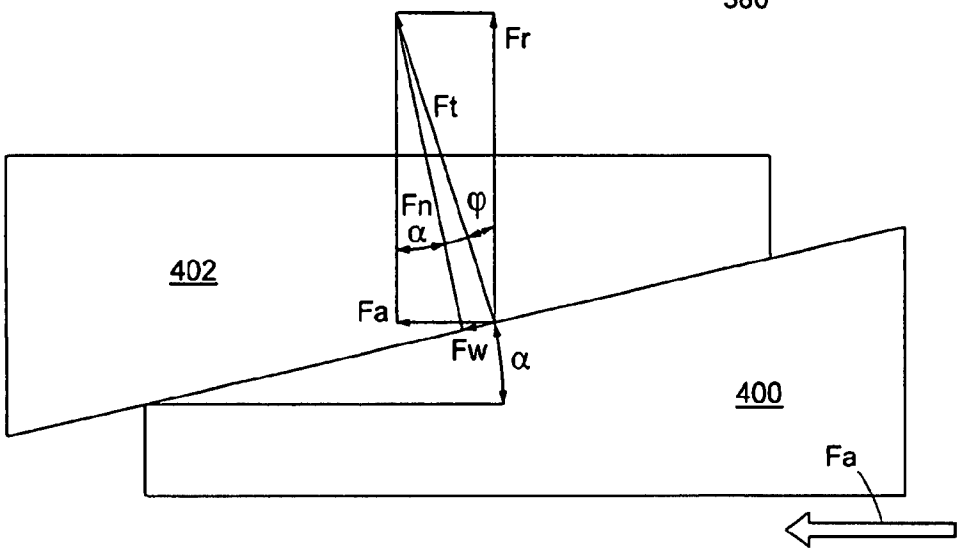
FIG. 20 schematically depicts forces between parts of the gripper system.

FIG. 20 shows an equilibrium of forces acting on an assembly of a wedge 400 and a segment 402, both of which are arranged horizontally. Applying a force Fa to the wedge 400 generates a clamping force Fr. Removing force Fa should lead to a self-releasing action of the system. Self-releasing takes place under the condition $$Fr*\sin(\alpha)>Fw \quad [1]$$

wherein Fw is the friction force between the wedge and the segment.

Considering a horizontal and a vertical force equilibrium and the required condition expressed in equation 1 the following expression can be derived for a self-releasing system:

$$\frac{\sin(\alpha)*\cos(\alpha+\varphi)}{\sin(\varphi)}>1 \quad [2]$$

Herein, $\tan(\phi)=\mu_{wedge}$, wherein $\mu_{wedge}$ is the coefficient of friction between wedge and segment.

Figure 21:
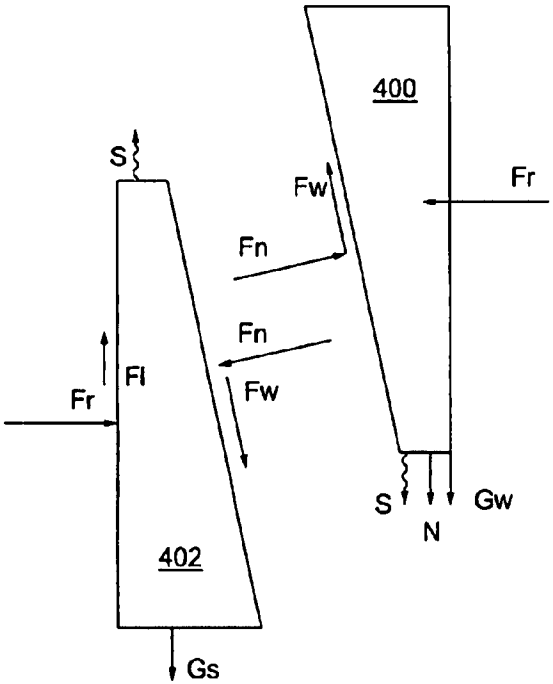
FIG. 21 schematically depicts other forces between parts of the gripper system.

FIG. 21 shows an equilibrium of forces acting on the assembly of wedge 400 and segment 402 when these are arranged vertically. Herein:

S=Spring pre-load [N]

N=Expansion load acting on the wedge [N]

Gs=Weight of the segments [N]

Gw=Weight of the wedge [N]

The coefficient of friction $\mu_{wedge}$ between the wedge and segment can be expressed as:

$$\mu_{wedge}=\frac{Fw}{Fn} \quad [3]$$

The condition to have a gripping action is:

$$\frac{Fl}{Fr}<\mu_{liner} \quad [4]$$

wherein $\mu_{liner}$ is the friction between the segment and the liner.

Considering horizontal and vertical force equilibrium and taking the condition of equation 4 into account provides the required condition to obtain a gripping action between the segment and the liner:

$$\frac{-S+Gs+Fn*(\sin\alpha+\mu_{wedge}*\cos\alpha)}{Fn*(\cos\alpha-\mu_{wedge}*\sin\alpha)}<\mu_{liner} \quad [5]$$

wherein:

S=Spring pre-load [kN];

Gs=Load of the segments [kN];

Fn=Load acting on wedge by pulling force on system (force generated by force multiplier) [kN];

$\mu_{liner}$=Friction coefficient with liner [-];

$\mu_{wedge}$=Friction coefficient with wedge [-].

Figure 22:
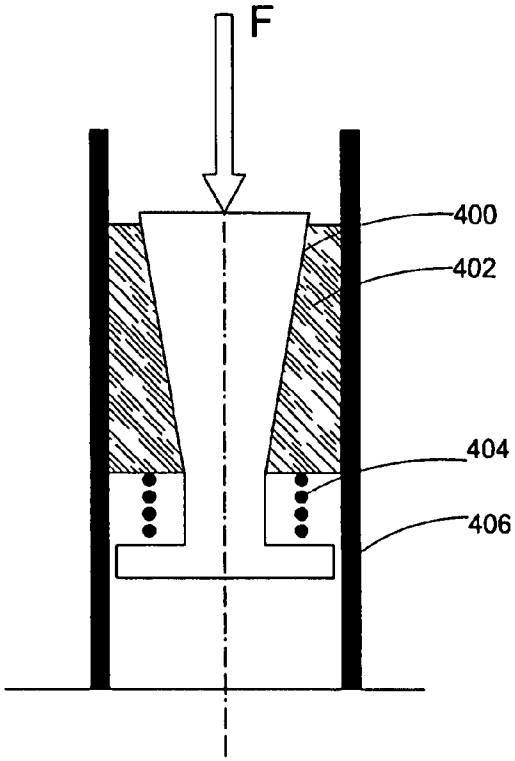
FIG. 22 schematically shows a longitudinal section of the gripper system.

In an exemplary embodiment (see FIG. 22), segments were provided with teeth having dimensions: angle $\beta=70°$, $t_{teeth}=0.5$ mm. A spring 404 provided a pre-load force of about 50 kg to create an initial anchor. Two exemplary gripper segments 402 were made, one with 7 teeth and one with 15 teeth, and tests were conducted with both. The grippers comprise for instance about 8 adjacent segments which enclose the corresponding wedge 400. The gripper system is for instance suitable for a 5.5 inch 20 lb/ft pipe.

After pre-loading the spring 404 to about 50 kg, the wedge 400 was loaded up to a force F of about 50 Tonnes. No significant sliding of the segments 402 with respect to the liner was observed during this test.

Subsequently the load F was increased to about 130 Tonnes. No significant sliding of the segments 402 with respect to the liner was observed. At this load F, the liner 406 started to expand plastically due to the high radial load. No significant damage to the tool has been observed. Subsequently the pipe 406 was successfully radially expanded by 21%. No leaks were found during these tests. The same test applies to both the liner gripper and the pulling shaft gripper, although they may be designed for different loads. The pulling shaft gripper may for instance be designed for loads in the order of 2 to about 20 Tonnes.

The liner system of the present invention will significantly reduce Non Productive Time (NPT) related to borehole problems, as the system reduces for instance losses, instability, inability to get the liner down, also in relatively deep wellbores. Also, the time to run the liner in a conventional is saved (one trip of the drill string), as the liner is incorporated in the drill string that is used to drill the wellbore section 6. This will be slightly offset by the time it takes to expand the liner. Expanding the liner allows larger internal diameters of the wellbore and (more) production. Also it allows a next section of the wellbore to have a larger internal diameter. The system also enables the retrieval of the BHA 14, which would not fit through the unexpanded liner. The technology is also suitable for drilling sidetracks.

The combination of liner drilling and expandable tubular liner offers advantages both in terms of cost saving and enables for instance drilling through difficult formations, setting liner at required depths, and being able to retrieve the BHA.

The use of the liner itself as housing for the force multiplier offers the advantage of a significantly longer stroke length, compared to a separate force multiplier joint that is run into the liner. Also, the force multiplier can give a positive indication when the liner is anchored into the formation.

As the system of the present invention uses the expandable tubular element as housing for the force multiplier, wherein the tubular element forms an outer wall of the pressure chambers, each stroke can be relatively long. The stroke length can be for instance in the range of 8 to 20 feet (about 2.5 to 7 meters), for instance about 12 feet (about 3 meters). Two stages, i.e. two pressure chambers, provide sufficient force to expand the liner and to force the anchor to engage the formation. In addition, as the tubular element is used as the outer wall of the pressure chambers, the system of the invention can expand liners having a relatively small inner diameter.

The pressure chambers can be pressurized up to for instance 500 bar or more. In practice, such pressures enable the system of the invention to pull the expander through the tubular element with a force up to for instance 500,000 N (50 metric tons) or more.

The system of the invention may include three or more stages, wherein each additional stage increases the available force for pulling the expander through the liner. Additional stages could for instance be required with decreasing liner diameter. In practice, the system of the invention is suitable for typical oil field casing diameters, such as 13⅜", 9⅝", 7⅝", 7", and 5½".

Many modifications of the above-described embodiments of the invention are conceivable within the scope of the appended claims. Features of respective embodiments can for instance be combined.

What is claimed is:

1. A system for lining a section of a wellbore, the system comprising:

an elongate drill string extending into the wellbore;

a force multiplier near a lower end the elongate drill string, wherein the force multiplier includes one or more pressure chambers;

an expandable tubular element in an unexpanded form thereof enclosing and acting as a housing of at least the force multiplier, wherein the tubular element constitutes an outer shell or wall of the one or more pressure chambers;

an expander for expanding the tubular element which is arranged at a lower end of the force multiplier; and anchoring means that are disposed on the exterior of the tubular element for anchoring the tubular element in the wellbore.

2. The system of claim 1 wherein an upper end of the tubular element is enclosed with an outer tubular element arranged in the wellbore.

3. The system of claim 1 wherein the drill string is adapted to pull the expander through the expandable tubular element in cooperation with the force multiplier.

4. The system of claim 1 wherein a wall of the tubular element decreases in thickness at a top end thereof.

5. The system of claim 1, further comprising a synchronizer.

6. A system for lining a section of a wellbore, the system comprising:

an elongate drill string extending into the wellbore, wherein the drill string includes a force multiplier near a lower end thereof, wherein the force multiplier includes:

a pulling shaft which is included in a lower portion of the drill string;

one or more gripper systems, each gripper system being controllable to grip or release the tubular element and/or the pulling shaft;

one or more pressure chambers being adapted to cooperate with the one or more gripper systems; and a synchronizer which is arranged between the one or more pressure chambers and the one or more gripper systems;

an expandable tubular element in an unexpanded form thereof enclosing and acting as a housing of at least the force multiplier;

an expander for expanding the tubular element which is arranged at a lower end of the force multiplier; and anchoring means that are disposed on the exterior of the tubular element for anchoring the tubular element in the wellbore.

7. The system of claim 6, wherein the pulling shaft comprises one or more flanges, wherein each pressure chamber is formed between one of the flanges and one of the gripper systems.

8. The system of claim 7 wherein the one or more flanges and the one or more gripper systems are provided with fluid tight seals.

9. The system of claim 6, wherein the synchronizer comprises:

a housing which is connected to one of the pressure chamber and the gripper system;

a spring which is arranged within the housing; and a pin which is pre-loaded by the spring and is connected to the other of the pressure chamber and the gripper system.

10. The system of claim 6 comprising:

a longitudinal fluid passage through the drill string for providing pressurized fluid to the pressure chambers; and an activating mechanism for redirecting the fluid from the longitudinal fluid passage to the pressure chambers.

11. A method of lining a section of a wellbore comprising the step of drilling a section of the wellbore using a drill string, wherein the drill string includes: a force multiplier near a lower end of the drill string, wherein the force multiplier comprises one or more pressure chambers; an expandable tubular element in an unexpanded form thereof enclosing and acting as a housing of at least the force multiplier, wherein the tubular element constitutes the outer shell or wall of the pressure chambers; an expander for expanding the tubular element which is arranged at a lower end of the force multiplier; and anchoring means that are disposed on exterior of the tubular element for anchoring the tubular element in the wellbore; the method further comprising the step of activating the force multiplier to pull the expander through the expandable tubular element for expanding the tubular element to an expanded form thereof.

12. A method of lining a section of a wellbore, comprising the step of drilling a section of the wellbore using a drill string, wherein the drill string comprises: a force multiplier near a lower end of the drill string; an expandable tubular element in an unexpanded form thereof enclosing and acting as a housing of at least the force multiplier; an expander for expanding the tubular element which is arranged at a lower end of the force multiplier; and anchoring means that are disposed on exterior of the tubular element for anchoring the tubular element in the wellbore; the method comprising the further step of: activating the force multiplier to pull the expander through the expandable tubular element for expanding the tubular element to an expanded form thereof; and confirming the anchoring of the anchoring means in the wellbore when a hydraulic pressure in the force multiplier drops below a threshold pressure.

13. The method of claim 12 including pulling the drill string and the expander into the expandable tubular element during the step of activating the force multiplier.

* * * * *